US007320466B2

(12) United States Patent
Ruggiero et al.

(10) Patent No.: US 7,320,466 B2
(45) Date of Patent: Jan. 22, 2008

(54) NEW YORK MAFIA BOARD GAME

(76) Inventors: David Ruggiero, 1745 - 74th St., Bklyn, NY (US) 11204; Paul Todaro, 12 Crescent Ave., Staten Island, NY (US) 10301

( * ) Notice: Subject to any disclaimer, the term of this patent is extended or adjusted under 35 U.S.C. 154(b) by 162 days.

(21) Appl. No.: 11/345,578

(22) Filed: Feb. 1, 2006

(65) Prior Publication Data

US 2007/0176359 A1 Aug. 2, 2007

(51) Int. Cl.
*A63F 3/00* (2006.01)

(52) U.S. Cl. ..... 273/243; 273/256; 273/278

(58) Field of Classification Search ..... 273/243, 273/256, 278

See application file for complete search history.

(56) References Cited

U.S. PATENT DOCUMENTS 1,509,312 A * 9/1924 Phillips ..... 273/256
2,026,082 A * 12/1935 Darrow ..... 273/256
2,976,044 A * 3/1961 Corpening ..... 273/256
4,062,544 A * 12/1977 Hankins ..... 273/256
4,136,881 A * 1/1979 Anspach ..... 273/256
4,360,205 A * 11/1982 Rimbold ..... 273/256
4,456,260 A * 6/1984 Hilton ..... 273/256
4,832,347 A * 5/1989 Monticolombi ..... 273/248

* cited by examiner

*Primary Examiner*—Vishu K. Mendiratta
(74) *Attorney, Agent, or Firm*—Jennifer Meredith, ESQ.; Meredith & Keyhani, PLLC

(57) ABSTRACT

A method of playing a board game comprising the steps: providing players each given money and starting at a first rank; providing dice; providing a game board having a plurality of playing spaces, that are either owned or available businesses, arranged around the outside of five connected boroughs of New York City; performing alternating player turns comprising the steps of: rolling dice; moving the player around spaces in a number corresponding to the roll; determining the ownership status of the space. If the space is owned and the owner of the space is of a higher rank the player must pay the owner, if the owner is of the same or less rank the player pays nothing. The owner may also offer the space for sale. If available, the player may purchase the space. The purpose is to purchase spaces or properties to move up to the highest rank.

20 Claims, 4 Drawing Sheets

NEW YORK MAFIA BOARD GAME

The present invention relates generally to board games and more particularly to a game in which the goal is to become the godfather.

Board games are known within the art. Generally, players move around a board to the end to be declared a winner. Example of prior art board games includes U.S. Pat. Nos. 1,125,867, 3,883,142, 3,572,718, 4,629,195, 5,190,292, 5,478,086, 5,516,290, 5,611,537, 5,662,327, 5,810,359 the disclosures of which are incorporated by reference in their entirety for all purposes.

The present invention, though, relates generally to a board game that resembles the five boroughs of New York City in which the goal is to move up in rank, by acquiring playing spaces or properties to become a winner and The Godfather.

SUMMARY OF THE INVENTION

The present invention relates to board games and more particularly a board game that is around the boroughs of New York City in which the goal is to become a godfather.

According to one embodiment of the present invention, a method of playing a board game is disclosed, the method comprising the steps of: providing at least two players, wherein each player is given a predetermined amount of play money and starts as at a first rank; one of the at least two players is designated as a commission representative; providing a plurality of dice; providing a game board having a plurality of playing spaces arranged around the outside of five connected islands, wherein each playing space is a business that has an ownership status that is either owned or available and each of the five connected islands represents a borough of New York City; performing at least one alternating player turn, each of the at least one alternating player turn comprising the steps of: rolling the plurality of dice; moving the player around the playing spaces in a number corresponding to the roll; determining the ownership status of the playing space, wherein the playing space is owned the player must pay the owner, if the owner of the space is of a higher rank or the owner may also offer the playing space for sale for a price; wherein the playing space is owned the player pays nothing if the owner is of the same or less rank; wherein the playing space has an available ownership status, the player may purchase the property for a predetermined price; assigning a higher rank to the player upon the player purchasing a predetermined number of properties; and assigning a winner as the first player to become a predetermined winning rank.

A method of playing a board game, the method comprising the steps of: providing at least two players, wherein each player is given a predetermined amount of play money and starts at a nobody rank; assigning one of the at least two players as a commission representative; providing a plurality of dice; providing a game board having a plurality of playing spaces arranged around the outside of five connected islands representing the five boroughs of new york city, wherein each playing space is a business that has an ownership status that is either owned or available, wherein at each borough has at least one marker playing space and when player lands on the marker playing space, the player takes a marker card and performs the instructions on the marker card; performing at least one alternating player turn, each at least one alternating player turn comprising the steps of: rolling the plurality of dice; moving the player around the playing spaces in a number corresponding to the roll; determining the ownership status of the playing space, wherein the playing space is owned the player must pay the owner if the owner of the space is of a higher rank or the owner may also offer the playing space for sale for a price; wherein the playing space is owned the player pays nothing if the owner is of the same or less rank; wherein the playing space has an available ownership status, the player may purchase the property for a predetermined price; assigning a higher rank to the player upon the player purchasing a predetermined number of properties, wherein the ranks are in the order of nobody, associate, soldier, capo, underboss and godfather; and assigning a winner as the first player to become a godfather.

These and other features, aspects and advantages of the present invention will become better understood with reference to the following drawings, description and claims.

DETAILED DESCRIPTION OF THE DRAWINGS

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
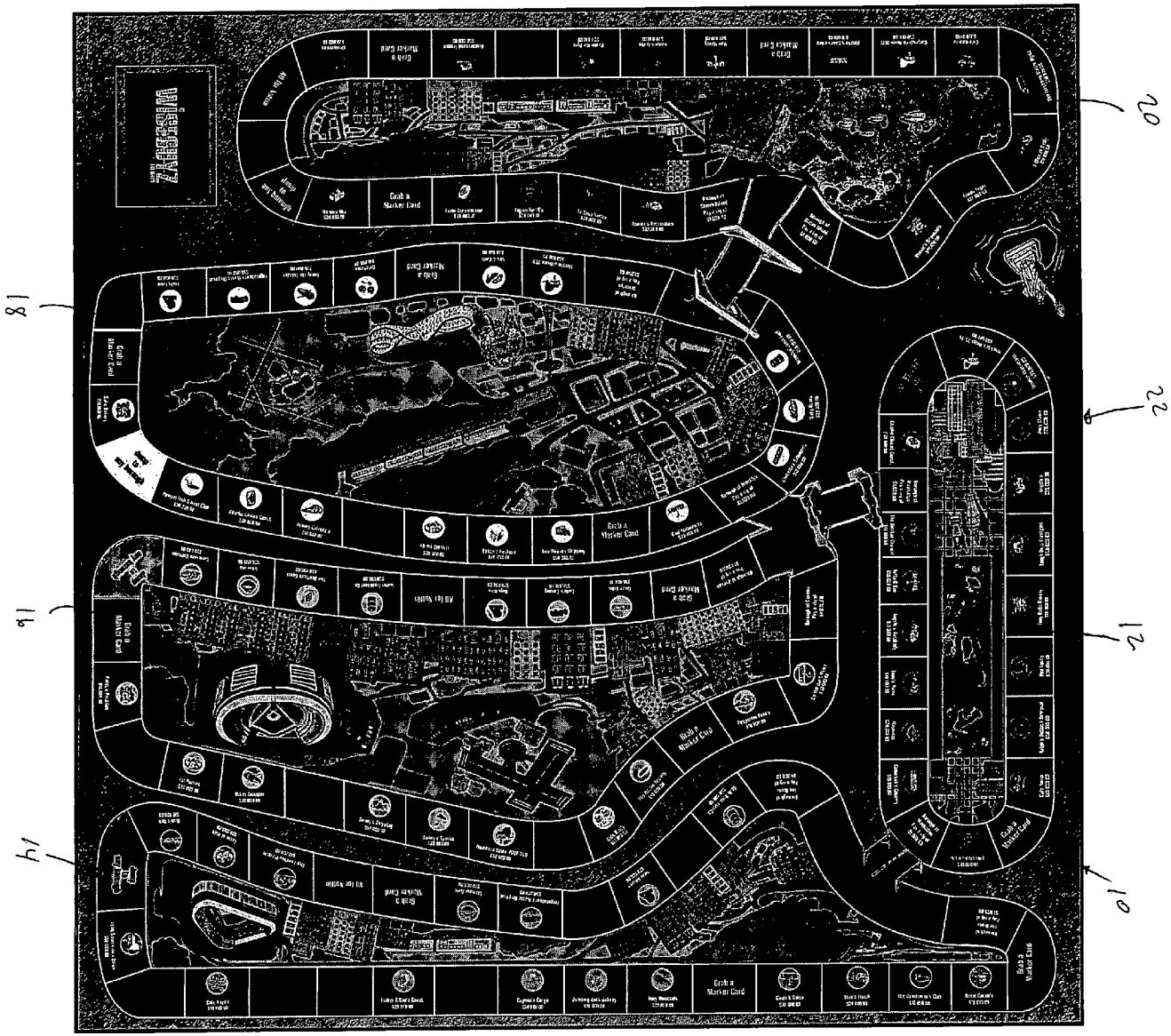
FIG. 1 is a picture of the board according to the present invention.
Figure 2:
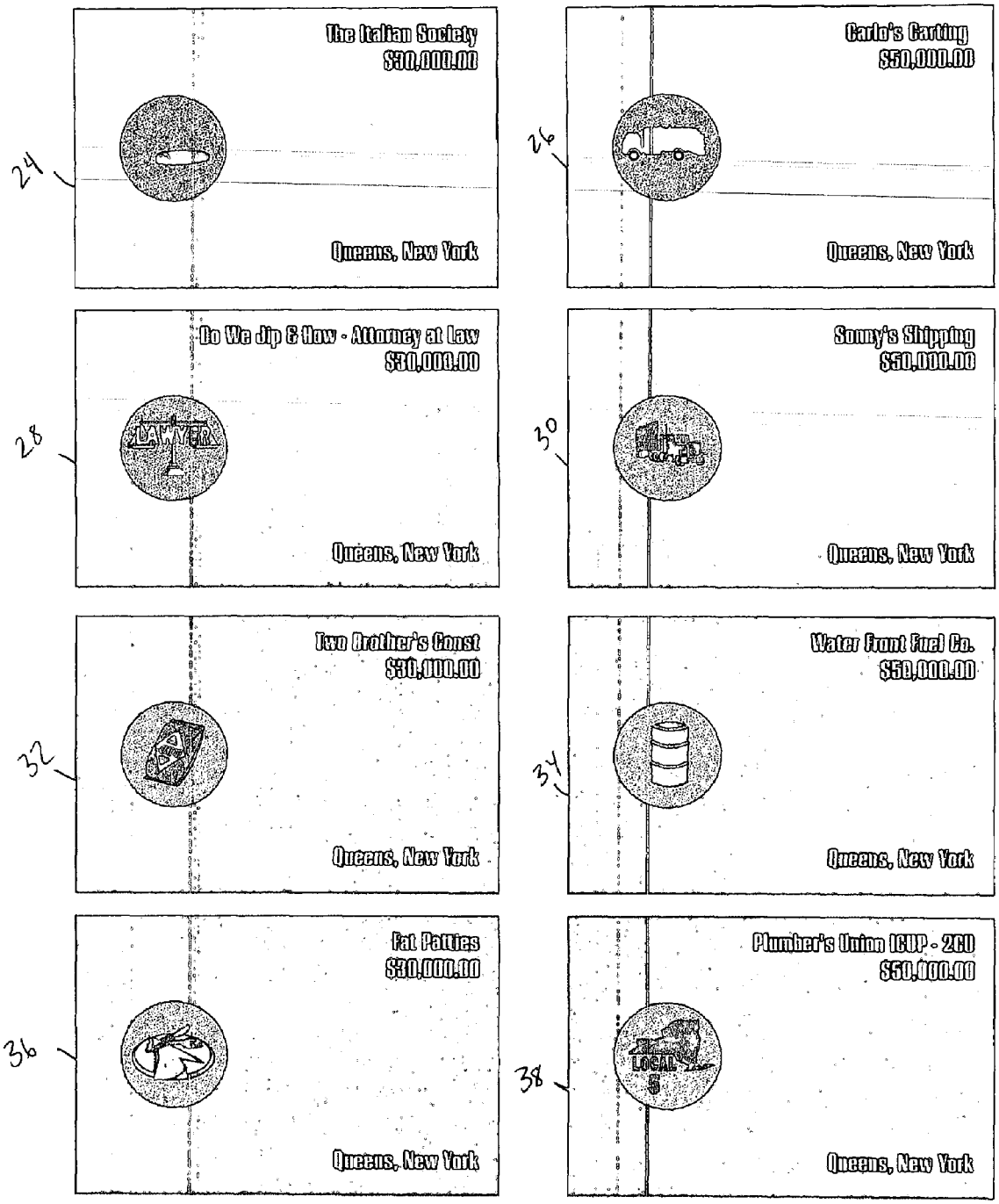
FIG. 2 are pictures of sample property cards according to the present invention.

The present invention provides a method of playing a board game, the method comprising the steps of: providing at least two players, wherein each player is given a predetermined amount of play money and starts as at a first rank. According to one embodiment, each player is given at least $90,000 and preferably $100,000 and starts as a nobody. One of the players is designated as a commission representative. Referring to FIGS. 1-2, there are two dice and the step of providing a game board (10) having a plurality of playing spaces (12) arranged around the outside of five connected islands (14, 16, 18, 20, 22), wherein each playing space (12) is a business (e.g. 24, 26, 28, 30, 32, 34, 36, 38) that has an ownership status that is either owned or available and each of the five connected islands (16, 18, 20, 22, 25) represents a borough of new york city borough and each borough has at least one marker playing space.

Each player takes the step of performing at least one alternating player turn, each alternating player turn comprising the steps of: rolling the plurality of dice; moving the player around playing spaces (12) in a number corresponding to the roll; determining the ownership status of the playing space, wherein the playing space is owned the player must pay the owner if the owner of the space is of a higher rank or the owner may also offer the playing space for sale for a price; wherein the playing space is owned the player pays nothing if the owner is of the same or less rank; wherein the playing space has an available ownership status, the player may purchase the property for a predetermined price; assigning a higher rank to the player upon the player purchasing a predetermined number of properties; and assigning a winner as the first player to become a predetermined winning rank. The predetermined winning rank may be the godfather rank.

Figure 3:
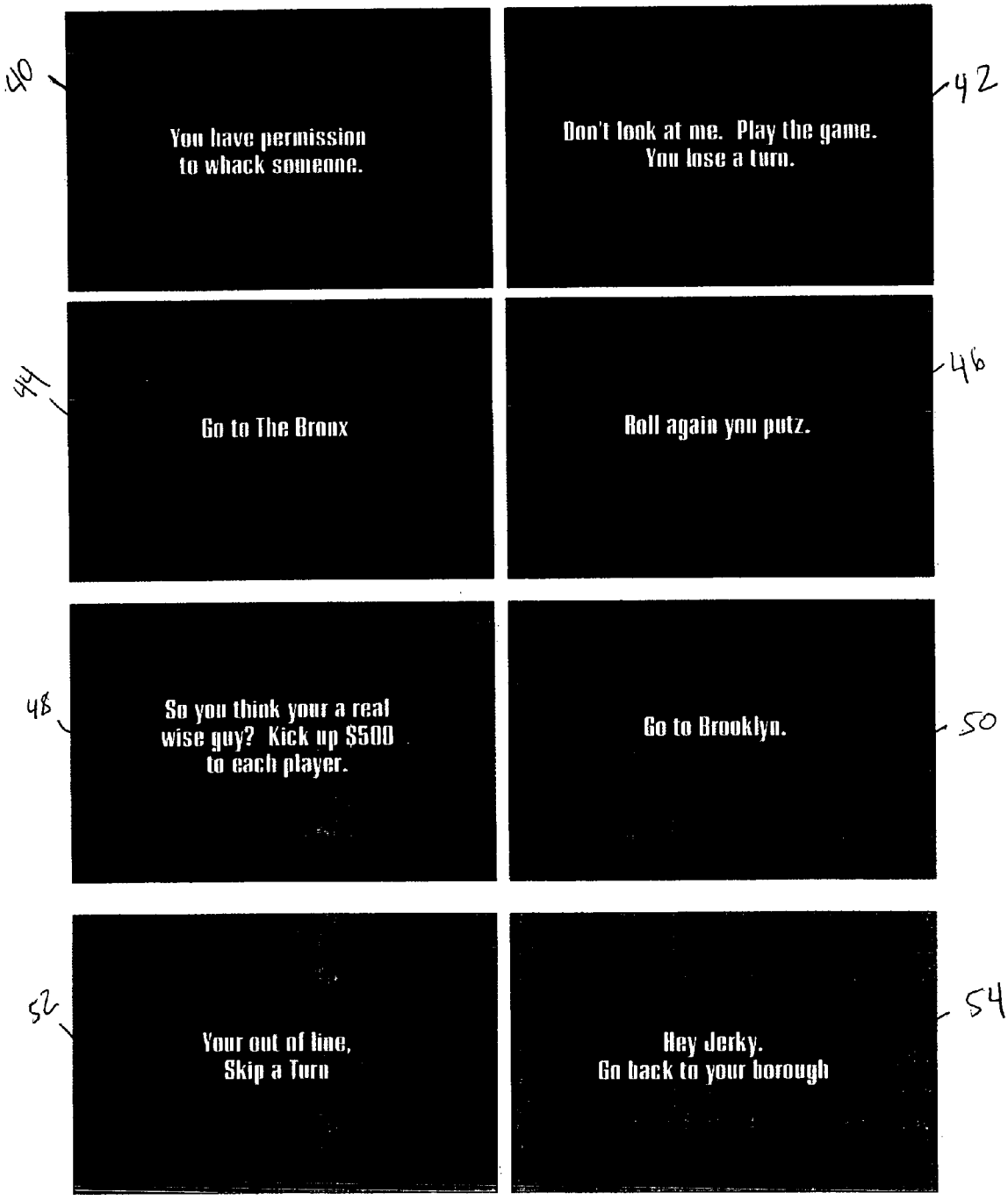
FIG. 3 is a picture of sample marker cards.
Figure 4:
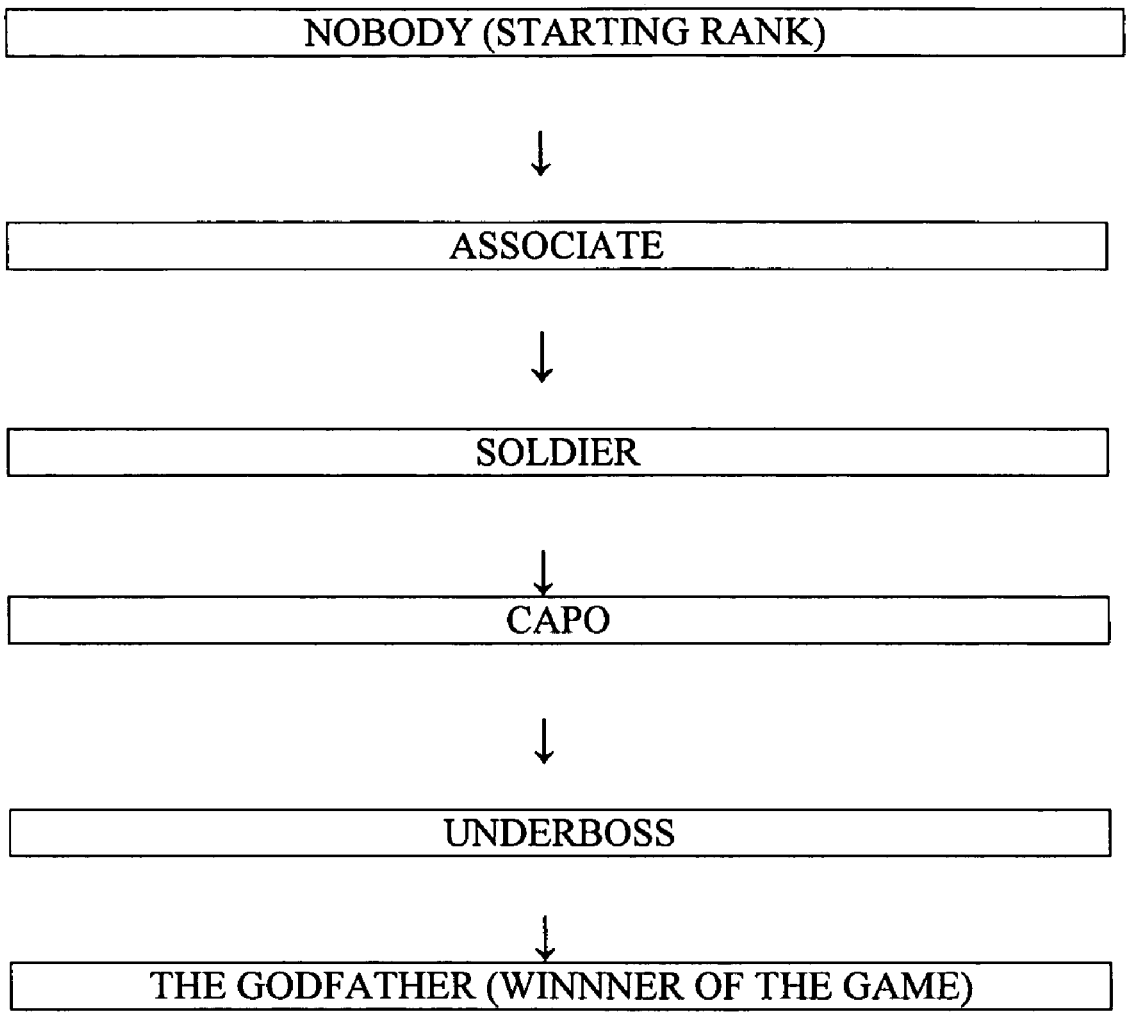
FIG. 4 is a picture of one embodiment of rankings according to the present invention.

The playing space (12) may also be a marker playing space. If the playing space (12) is a marker playing space, the player takes a marker card and follows the instructions on the marker card. FIG. 3 depicts sample marker cards. By way of example, card 40 states "You have permission to whack someone" This card gives the player permission to kill off another player. Card 42 is a lose a turn card. Card 44 sends the player to the Bronx (X). Card 46 instructs the player that they get another turn. Card 48 instructs the player to give every other player $500. Card 50 instructs the player to go to Brooklyn. Can 52 instructs the player skip a turn. Card 54 instructs the play to go back to their borough. These cards are merely examples of marker cards, there may be a variety of instructions and marker cards.

The businesses on the playing space may be, for example, a deli, auto body shop, fish store, bookie place, strip joint, social club, waste management company, construction company, fire works network, escort service, fuel distribution company, pizzeria, union, restaurant, lawyer, trucking company.

The first rank may be a nobody and the player may moves up the ranks in the order of nobody, associate, soldier, capo and underboss according to the number and type of businesses owned. For example, a player may move up in rank to become an associate by acquiring a deli, an auto body, a fish store and a bookie place. The player may moves up in rank to become a soldier by acquiring a strip joint, social club, waste management company and a construction company. The player moves up in rank to become a capo by acquiring a fire works network, escort service, fuel distribution company and a pizzeria. The player moves up in rank to become a underboss by acquiring a union, restaurant, lawyer and trucking company. Once the player becomes the underboss, the next step is giving a ring to the player who became an underboss rank; requiring every other player to kiss the ring of said godfather player; and declaring the player the winner.

The method may also comprise the step of: whacking a second player when a first player obtains a whacking marker card and the first player is either a capo or underboss rank and the first player pays the commission a predetermined amount of money, the second player may no longer continue.

The method may also comprise the step of: taking over a business by paying each player the predetermined value of the business, wherein the takeover player must land on the playing space of the business and be of a higher rank than the owner of the business and the takeover player may decide not to take over the business then the owner of the business must give the takeover player a predetermined amount of money not to take their business.

We claim:

1. A method of playing a board game, said method comprising the steps of:

providing at least two players, wherein each said player is given a predetermined amount of play money and starts as at a first rank;

one of said at least two players is designated as a commission representative;

providing a plurality of dice;

providing a game board having a plurality of playing spaces arranged around the outside of five connected islands, wherein each said playing space is a business that has an ownership status that is either owned or available and each of said five connected islands represents a borough of new york city;

performing at least one alternating player turn, each said at least one alternating player turn comprising the steps of:

rolling said plurality of dice;

moving said player around said playing spaces in a number corresponding to the roll;

determining said ownership status of said playing space, wherein said playing space is owned said player must pay said owner if the owner of said space is of a higher rank or said owner may also offer said playing space for sale for a price;

wherein said playing space is owned said player pays nothing if said owner is of the same or less rank;

wherein said playing space has an available ownership status, said player may purchase said property for a predetermined price;

assigning a higher rank to said player upon said player purchasing a predetermined number of properties; and assigning a winner as the first player to become a predetermined winning rank.

2. A method as in claim 1, wherein said predetermined amount of money is at least $90,000.

3. A method as in claim 1, wherein at each said borough has at least one marker playing space and when said player lands on said marker playing space, said player takes a marker card.

4. A method as in claim 3, wherein said marker card contains a set of instructions.

5. A method as in claim 1, wherein said business is selected from the group consisting of deli, auto body shop, fish store, bookie place, strip joint, social club, waste management company, construction company, fire works network, escort service, fuel distribution company, pizzeria, union, restaurant, lawyer, trucking company.

6. A method as in claim 1, wherein said first rank is nobody and said player moves up the ranks in the order of nobody, associate, soldier, capo and underboss according to the number and type of businesses owned.

7. A method as in claim 6, wherein said player moves up in rank to become an associate by acquiring a deli, an auto body, a fish store and a bookie place.

8. A method as in claim 7, wherein said player moves up in rank to become a soldier by acquiring a strip joint, social club, waste management company and a construction company.

9. A method as in claim 8, wherein said player moves up in rank to become a capo by acquiring a fire works network, escort service, fuel distribution company and a pizzeria.

10. A method as in claim 9, wherein said player moves up in rank to become a underboss by acquiring a union, restaurant, lawyer and trucking company.

11. A method as in claim 10, further comprising the step of:

Giving a ring to said player who becomes a underboss rank;

requiring every other player to kiss the ring of said godfather player; and declaring said player the winner.

12. A method as in claim 1, wherein said predetermined winning rank is the godfather rank.

13. A method as in claim 1, further comprising the step of:

whacking a second player when a first player obtains a whacking marker card and said first player is either a capo or underboss rank and said first player pays said commission a predetermined amount of money, wherein said second player may no longer continue.

14. A method as in claim 1, further comprising the step of:

taking over a business by paying each player the predetermined value of said business, wherein the takeover player must land on said playing space of said business and be of a higher rank than the owner of said business and said takeover player may decide not to take over said business then said owner of said business must give said takeover player a predetermined amount of money not to take their business.

15. A method as in claim 1, further comprising the step of:

whacking a second player when a first player obtains a whacking marker card and said first player is either a capo or underboss rank and said first player pays said commission a predetermined amount of money, wherein said second player may no longer continue.

16. A method as in claim 1, further comprising the step of:

taking over a business by paying each player the predetermined value of said business, wherein the takeover player must land on said playing space of said business and be of a higher rank than the owner of said business and said takeover player may decide not to take over said business then said owner of said business must give said takeover player a predetermined amount of money not to take their business.

17. A method of playing a board game, said method comprising the steps of:

providing at least two players, wherein each said player is given a predetermined amount of play money and starts as at a nobody rank;

one of said at least two players is designated as a commission representative;

providing a plurality of dice;

providing a game board having a plurality of playing spaces arranged around the outside of five connected islands representing the five boroughs of new york city, wherein each said playing space is a business that has an ownership status that is either owned or available, wherein at each said borough has at least one marker playing space and when said player lands on said marker playing space, said player takes a marker card and performs the instructions on said marker card;

performing at least one alternating player turn, each said at least one alternating player turn comprising the steps of:

rolling said plurality of dice;

moving said player around said playing spaces in a number corresponding to the roll;

determining said ownership status of said playing space, wherein said playing space is owned said player must pay said owner if the owner of said space is of a higher rank or said owner may also offer said playing space for sale for a price;

wherein said playing space is owned said player pays nothing if said owner is of the same or less rank;

wherein said playing space has an available ownership status, said player may purchase said property for a predetermined price;

assigning a higher rank to said player upon said player purchasing a predetermined number of properties, wherein said ranks are in the order of nobody, associate, soldier, capo, underboss and godfather; and assigning a winner as the first player to become a godfather.

18. A method as in claim 17, wherein said business is selected from the group consisting of deli, auto body shop, fish store, bookie place, strip joint, social club, waste management company, construction company, fire works network, escort service, fuel distribution company, pizzeria, union, restaurant, lawyer, trucking company.

19. A method as in claim 18, wherein said first rank is nobody and said player moves up the ranks in the order of nobody, associate, soldier, capo and underboss according to the number and type of businesses owned.

20. A method as in claim 19, further comprising the steps of:

moving up in rank, by a player, from a nobody to become an associate by acquiring a deli, an auto body, a fish store and a bookie place;

moving up in rank, by said player, from an associate to become a soldier by acquiring a strip joint, social club, waste management company and a construction company;

moving up in rank, by said player, from a soldier to become a capo by acquiring a fire works network, escort service, fuel distribution company and a pizzeria;

moving up in rank, by said player, from a capo to an underboss by acquiring a union, restaurant, lawyer and trucking company; and moving up in rank, by said player, from an underboss to The Godfather by giving a ring to said player who becomes a underboss rank, requiring every other player to kiss the ring of said godfather player; and declaring said player the winner.

* * * * *